US005294319A

United States Patent [19]

Kaczur et al.

[11] Patent Number: 5,294,319

[45] Date of Patent: Mar. 15, 1994

[54] HIGH SURFACE AREA ELECTRODE STRUCTURES FOR ELECTROCHEMICAL PROCESSES

[75] Inventors: Jerry J. Kaczur; David W. Cawlfield, both of Cleveland, Tenn.

[73] Assignee: Olin Corporation, Stamford, Conn.

[21] Appl. No.: 9,905

[22] Filed: Jan. 27, 1993

Related U.S. Application Data

[63] Continuation-in-part of Ser. No. 739,041, Aug. 1, 1991, which is a continuation-in-part of Ser. No. 456,437, Dec. 26, 1989, Pat. No. 5,041,196.

[51] Int. Cl.[5] ..... C25B 11/04

[52] U.S. Cl. ..... 204/290 R; 204/284; 204/290 F

[58] Field of Search ..... 204/284, 290 E, 192.11, 204/200 R; 427/77, 123, 124, 125, 126.5, 327, 328; 205/212, 219

[56] References Cited

U.S. PATENT DOCUMENTS

| | | | |
|---|---|---|---|
| 2,163,793 | 6/1939 | Logan | 204/9 |
| 2,717,237 | 9/1955 | Rampel | 204/101 |
| 3,486,928 | 12/1969 | Rhoda et al. | 117/130 |
| 3,674,675 | 7/1972 | Leaman | 204/290 F |
| 3,698,939 | 10/1972 | Leaman | 117/130 |
| 4,456,510 | 6/1984 | Murakami et al. | 204/101 |
| 4,542,008 | 9/1985 | Capuano et al. | 423/477 |
| 4,683,039 | 7/1987 | Twardowski et al. | 204/95 |
| 4,737,257 | 4/1988 | Boulton | 204/290 R |
| 4,806,215 | 2/1989 | Twardowski | 204/98 |
| 4,853,096 | 8/1989 | Lipsztajn et al. | 204/101 |
| 4,902,535 | 2/1990 | Garg et al. | 427/292 |
| 5,041,196 | 8/1991 | Cawlfield et al. | 204/101 |
| 5,084,149 | 1/1992 | Kaczur et al. | 204/101 |

FOREIGN PATENT DOCUMENTS

| | | |
|---|---|---|
| 53-19561 | 3/1956 | Japan . |
| 81-158883 | 12/1981 | Japan . |

OTHER PUBLICATIONS

"Chlorine Dioxide Chemistry and Environmental Impact of Oxychlorine Compounds" published 1979 by Ann Arbor Science Publishers, Inc. at pp. 111-144.

"Modern Electroplating" sponsored by The Electrochemical Society, Inc. (1974) Chapter 13, at pp. 342-357.

"Deposition of Platinum by Chemical Reduction of Aqueous Solutions" by F. H. Leaman. appearing in Connector Products Division, AMP, Inc. Harrisburg, Pa. May 1972, at pp. 440-444.

"Barrel Plating by Means of Electroless Palladium" by R. N. Rhoda, appearing in Journal of the Electrochemical Society, (Jul. 1961) 108, at pp. 707-708.

"Immersion Plating of the Platinum Group Metals" by R. W. Johnson, appearing in Journal of the Electrochemical Society, 108, No. 7. (Jul. 1961) 632-635.

Chemical Abstracts, vol. 103, No. 12, "Formation of Platinum or Platinum Alloy Electrodes on Ion-Exchanging Membranes". Sep. 23, 1985.

Chemical Abstracts, vol. 108, No. 26, "Platinum Film Electrodes (I) Platinum Film on Titanium or Titanium Dioxide-Covered Titanium" Jun. 27, 1988.

*Primary Examiner*—Kathryn Gorgos

*Attorney, Agent, or Firm*—William A. Simons; H. Samuel Kieser

[57] ABSTRACT

A porous, high surface area electrode comprising a fine fibrous conductive substrate having a density less than about 50% and a specific surface area to volume ratio of greater than about 30 $cm^2/cm^3$. The individual fibers of the substrate have a length to diameter aspect ratio greater than 1000:1. An electrocatalyst covers at least a portion of the substrate. A current distributor is electrically connected to the coated substrate. The method of fabricating the electrode includes fabricating a fine fibrous conductive substrate, preparing the surface of the substrate for receiving an electrocatalyst covering thereon, preparing the electrocatalyst for application to the substrate and applying the electrocatalyst to the substrate. Optionally, the electrode may be further treated to promote adhesion of the electrocatalyst to the substrate.

17 Claims, No Drawings

HIGH SURFACE AREA ELECTRODE STRUCTURES FOR ELECTROCHEMICAL PROCESSES

CROSS-REFERENCE TO RELATED APPLICATION

This application is a continuation-in-part of application Ser. No. 07/739,041 filed Aug. 1, 1991, still pending, which in turn is a continuation-in-part of application Ser. No. 07/456,437 filed Dec. 26, 1989, now U.S. Pat. No. 5,041,196, issued Aug. 20, 1991.

BACKGROUND OF THE INVENTION

This invention relates to the fabrication and structure of electrocatalyst coated 3-dimensional porous high surface area electrode structures for use in electrolytic cells for a variety of electrochemical production processes as anodes or cathodes. More particularly, this invention relates to the fabrication and structure of electrocatalyst coated high surface area porous type electrode structures fabricated from fine metallic and/or conductive ceramic oxide composition fibrous materials.

High surface area electrodes are finding increasing use in recent years in various electrochemical processes. This is because of new advances in material processing science in the preparation and manufacture of high surface area metallic and electrically conductive inorganic substrates as well as due to the increasing need for high selectivity electrodes to achieve higher conversion efficiencies in electrochemical processes.

There are several types of commercially available high surface electrodes on the market today. These are generally made from graphite in the form of felts, foams and woven structures. In general, the felts are made from fine, short fibers that are mechanically interlocked. A problem with graphite is that it is not as conductive as metals and that there are problems with producing an adequate electrical or physical bond between the graphite material and a current distributor. In addition, significant areas of the felt structure may not participate in the electrode reactions because of minimal mechanical/electrical contact between the fibers because of their short lengths. These fibers have length to diameter ratios that are generally less than 1000:1. These graphite structures are also generally limited to operation at low cell current densities because of the low conductivity of graphite in combination with the minimal graphite inter-fiber contacts within the structure. In addition, graphite is not generally stable as an oxygen generating electrode.

Metallic materials are also now available prepared from copper, nickel and stainless steels and their alloys. One material type is in the form of a metallic foam product with specifications in terms of pores per inch (PPI). These materials range from 10 to 300 PPI, but the actual active specific surface area is generally below 30 $cm^2/cm^3$. In addition, the metallic foams have mechanical properties that can range from being very hard and incompressible to very fragile and brittle. In addition, electrode structures may be prepared from sintering fine powders of these metals, but the density of these materials is generally limited to about 60% or greater, which greatly increases the hydraulic pressure drop through the structure, making it uneconomical or impossible to operate without employing very high pressure rated electrochemical cell designs.

Metallic felts prepared from fibers are also now becoming available, but these are generally prepared from stainless steels using small short fibers with length to diameter aspect ratios that are considerably less than about 1000:1. These felts are made by air-laying or wet filtration methods, and cannot be made by these methods using fibers with larger diameter to length aspect ratios. Woven stainless steel materials are also available made from the fine diameter wires or tow fiber bundles containing multiple filaments. Since these woven type structures use continuous length filaments, the length to diameter aspect ratio is greater than 1000:1. These stainless steel woven materials are themselves very conductive, as are their surfaces, and there is no problem with fiber to fiber conductive paths in the structure because of this conductivity.

In the case of valve metal woven wire constructions, for example titanium, the conductive paths through just the long wire lengths are not adequate for an even distribution of the current throughout the structure. The woven material to be used as an effective 3-dimensional high surface area electrode structure also requires a fiber to fiber electrical contact, which depends on the fiber surfaces and their corresponding areas being conductive and intimately in contact with each other. Since valve metals form protective nonconductive oxide films on their surfaces, these conductive contact points may not be stable in the electrochemical system and form nonconductive oxides, and the material will then not be suitable as an electrode. Also, woven materials, both made from either stainless steel or valve metals, have been observed to not be suitable as electrode structures in electrochemical cells for operation at current densities greater than about 1 to 2 KA/m2. One explanation is that the 3-dimensional electrical conductivity of the structure relying on a mechanical fiber to fiber contact is not adequate above this range, resulting in a substantially higher cell electrode operating voltage with corresponding changes in the competitive electrochemical reactions occurring at the electrode surfaces. Another explanation for inadequate performance of woven structures made from multi-filament strands (or tow bundles) is that the porosity of these structures is nonuniform, such that the zones with highest surface area do not allow penetration of current through the electrolyte between closely spaced fibers.

The technology for the processing and production of valve metals, such as titanium, in the form of fine wire, filaments and tow fiber is now available. The problem is in fabricating the filamentary valve metal raw material into a form that is suitable as a 3-dimensional, uniformly conductive high surface area electrode structure and developing methods for the application of an even, economical amount of an active electrocatalyst material onto the structure. In addition, a method for efficiently and evenly distributing electrical current to the structure is also required to be suitable for an electrochemical process. The higher the effective surface area of the electrode structure, with a uniform distributed current density, the higher the single pass conversion efficiency performance of the electrode for the specific electrochemical process application.

SUMMARY OF THE INVENTION

It is an object of the present invention to provide an improved electrode that may be used in an electrolytic process and apparatus.

It is a more specific object of the present invention to provide an improved 3-dimensional, porous, high surface area, flow through electrode that can be used as an electrode in an electrolytic process and apparatus.

It is another yet another object of the present invention to provide an improved method of fabricating a porous, high surface area electrode.

These and other objects and advantages of the present invention may be achieved through the provision of a porous, high surface area electrode which may comprise a fine fibrous conductive substrate having a density less than about 50% and a specific surface area to volume ratio of greater than 30 $cm^2/cm^3$ with an electrocatalyst covering the substrate. The individual fibers have a length to diameter aspect ratio greater than 1000:1. A current distributor is electrically connected to the electrocatalyst coated substrate.

In accordance with the present invention, the method of fabricating a porous, high surface area electrodes comprises fabricating a fine fibrous conductive substrate having a density less than about 50% and a specific surface area to volume ratio greater than about 30 $cm^2/cm^3$ from fibers having a length to diameter aspect ratio of greater than 1000:1. The surface of the substrate is prepared for receiving an electrocatalyst coating thereon. The electrocatalyst is prepared for application to the substrate and then applied thereto.

DETAILED DESCRIPTION

An electrode according to the present invention comprises a high surface area electrode structure fabricated from long, fine fibers of a filamentary type material. The physical structure of the electrode may be mechanically interlocked metallic felts or mats, woven or knitted structures, semi-sintered fiber filled pads or spot-welded felts. The electrode structure is fabricated such that it has a density less than about 50%. Density may be defined as (1 − void volume). For example, a 40% density means that the structure has a 60% void volume. Additionally, the physical structure presents a specific surface area to volume ratios of greater than about 30 $cm^2/cm^3$ and is composed of fibers with a length to diameter aspect ratio greater than 1000:1. Preferably, the aspect ratio is in the range of 1000:1 to 5,000,000:1, or more preferably 1000:1 to 2,000,000:1. The most preferred range is 1000:1 to 1,000,000:1.

The electrode structure includes a substrate material coated or otherwise provided with an electrocatalyst. Examples of suitable materials for use as the substrate include the valve metals such as titanium, niobium, zirconium, tantalum, aluminum, tungsten, hafnium and their mixtures and alloys thereof. Also, a stable conductive ceramic-type material may be used for the substrate. Examples of such a material are the Magneli phase titanium suboxides, $Ti_4O_7$ and $Ti_5O_9$, which are currently being commercially marketed under the tradename of EBONEX® by Ebonex Technologies, Inc.

Examples of suitable electrocatalyst materials include platinum, silver and gold and other precious metals, and the platinum group oxides such as oxides prepared from ruthenium, rhodium, palladium, iridium and osmium and mixtures and alloys thereof.

The thickness of the electrocatalyst coated substrate may be in the range of from about 0.010 inches (0.0254 cm) to about 5 inches (12.7 cm) and preferably in the range of from about 0.030 inches (0.0762 cm) to about 4 inches (10.16 cm).

The electrode structure can be employed directly into the electrochemical cell as a removable felt or mat, physically mounted by mechanical pressure against a suitably conductive or plated current distributor, or as a completed electrode structure that is electrically connected to a current distributor or backing plate by a physical bonding method.

The current distributor or backing plate may be in a screen, expanded metal, perforated plate or solid plate form. The backing plate or current distributor may be made of a graphite material which can be surface treated with the same or similar materials used as the electrocatalyst on the porous high surface area electrode structure mentioned above. Other alternative materials suitable for use as a current distributor include oxidation chemical resistant valve metal structures such as titanium, tantalum, niobium or zirconium with or without a conductive or electrocatalytic metallic film or oxide coating. The selected electrocatalytic coating types are metallic platinum, gold or palladium or other precious metals or oxide-type coatings. Other coatings such as ferrite-based magnesium or manganese-based oxides may also be suitable.

In general, electrodes of the present invention may be fabricated in five (5) steps, including the 3-dimensional physical fabrication of the high surface area electrode structure from long, fine fibrous or filamentary type materials, surface preparation of the fine fibers for the electrocatalyst coating and/or plating, preparation of the electrocatalyst formulations for the coating/plating operation, the coating/plating operation under specific conditions, and optional post treatment methods for annealing, consolidating, or adhering the electrocatalyst to the electrode substrate.

The first step involves the physical fabrication of the 3-dimensional high surface area electrode structure from long, fine fibrous or filamentary type valve metals or fibrous form electrically conductive ceramics into various physical structures such as a mechanically interlocked metallic felts or mats, woven or knitted structures, semi-sintered fiber felts or pads, spot welded felts, etc. The individual electrode fibers of the high surface area structure may be pre-coated with the electrocatalyst before the general electrode structure is fabricated into the felt or mat form or it can be coated or plated after the final form of the physical electrode structure is completed.

The completed felt pad form is preferred to have some thickness resiliency or flexibility that may be required in electrochemical cell designs in order to allow for good physical compression contact to an adjoining membrane or separator in a cell. In electrochemical cell system designs using a removable felt pad and zero gap configuration, the flexible mechanical compression helps in promoting the electrical contact to the current distributor and physical contact with the membrane.

The fine, long fibrous fiber forms can be made or produced from wires as well as through other numerous methods in the art including size reduction drawing methods through dies, melt spin casting, flat sheet slitting into strands, etc. The fine fibrous forms may also be produced from mechanical machining processes called turnings which can be of very long continuous lengths with different fiber width aspect ratios than cylindrical wire type forms.

An important factor in improved electrode performance is that the fibers incorporated into the structure have high length to diameter aspect ratios, especially for fibers less than about 10 mil (254 microns) in diameter. The aspect ratio required for good electrode performance is greater than about 1000:1, and preferably in the range of about 1000:1 to 5,000,000:1, more preferably, about 1000:1 to 2,000,000:1, and most preferred, 1000:1 to 1,000,000:1.

The reason for the high length to diameter aspect ratios is that as the fiber diameters get smaller, the chances for continuous electrical conductivity in the structure becomes smaller because of less potential points of inter-fiber contact with each other in the electrode structure. Good and uniform electrical current distribution in high surface area electrodes is critical for high electrochemical conversion performance. In addition, as the individual fibers become smaller than about 1 mil (24 microns), there is a "floating" effect that occurs with the fibers in the structure where the fibers can float in the solution stream and bulk-up, such that they can have very little continuous point to point contact throughout the electrode structure and to the current distributor. In such a case, not all areas of the electrode are available for electrochemical reactions, resulting in decreased performance in terms of electrochemical product conversion per pass through the electrode.

The "floating" effect can be compensated by mixing in an amount of coarser or larger diameter size fibers in with the finer fibers during fabrication. This amount can be from 0.01% to 50% of the filament number content of the felt, or more preferably 0.10% to 40%. The larger diameter fibers help to stabilize the finer fibers in place by reducing movement and also help in the uniformity of the current distribution in the felt conductivity network. However, the specific surface area of the electrode can be significantly reduced if the larger fiber to smaller fiber number ratio is too high in the electrode structure.

The selection of the diameter ratios of the coarser fibers to the finer fibers should be in the range of 1.5:1 to 10:1, or more preferably 2:1 to 8:1 and be such that there is no significant fluid flow disruption through the felt or mat electrode structure since good flow distribution is important for electrode electrochemical conversion performance. The amount of coarser fibers and the diameter ratio will depend upon the specific electrochemical reaction process being considered and take into account the physical flow properties of the solutions involved such as viscosity and surface tension.

Another important factor in the high surface fibrous flow-through electrode structures is that the specific surface area should be 30 $cm^2/cm^3$ or greater for achieving high conversion rates per single pass through the electrode structure versus a planar type electrode and for reducing the internal electrode local current density at the electrode surfaces.

The final form of the electrode structure may be a felted mat, woven, knitted or loose compressed fiber fill with a mechanical bonding means such as stitching or stapling. The fine fibrous forms may be fabricated into a mat or felt by hand or mechanically placing the individual fibers into a die until a specified thickness is built up and then compressing the pile of fibers to a final thickness. The fibers can also be mechanically interlocked or held in a removable type of mat or felt structure form using one or more mechanical dimensional holding or forming methods including the use of metallic or non-conductive wire form in a stitching, stapling, or sewing means. The fibers before mechanical bonding can be coated with the conductive electrocatalyst coating.

Alternately, and more preferably, the fine fibrous forms may be sintered to metallurgically or chemically bond the fibers together at fiber to fiber contact points. Also, the individual fibers may be held together by spot welding. The fabricated fiber felts or mats may be thermally sintered or multiple point spot welded onto a current distributor or collector such as plate, perforated sheet, or screen to form the entire physical electrode structure for physical integrity and/or electrical conductivity. When spot welding is selected as the only bonding means, spot welds are preferably spaced more closely together than the length of individual fibers in the structure, in the range of 0.1 cm to 10 cm apart. The diameter of the weld be varied by changing the size of the spot welding head. The spot welding process compresses the electrode structure to a high density that is not suitable for efficient electrode performance, therefore, it is preferred to limit the total area of spot welds to less than 20%, and preferably less than about 5% of the superficial electrode area.

Alternatively, the fabricated electrode structures may be mechanically and electrically bonded or connected to the current distribution by mechanical means such as screws or the like. Conductive ceramic fiber type materials, such as EBONEX ®, may be available as composite fiber structures containing the ceramic in a powder form with a plastic, polymer or other type of binder system. These conductive fibers can be then be sintered together in a 3-dimensional structure by applying a thin mixture using the same or similar composition ceramic powder and binder system on the fibers and sintering at appropriate temperatures and processing conditions to produce the final electrode substrate structure.

The second step of fabrication involves the surface preparation of the high surface area substrate and/or its fiber components singly or by a combination of acid etching, chemical surface oxide removal, plasma gas etch processing, or by a chemical/electrochemical type reduction processing to promote the adherence of the electrocatalyst to the surfaces of the individual high surface area fibers composing the high surface area electrode structure. This may or not be needed depending on the specific coating and substrate used in the electrode. For example, the thermally formed ruthenium oxide coating formulations may not need the removal of the valve metal oxide film of the fibers. Also, structures prepared from conductive ceramic fibers such as EBONEX ®, may not need any surface preparation before application of the electrocatalyst.

This second process step serves to remove any natural occurring protective oxide films, particularly in the case where valve metals are used as the substrates. Generally, chemical etchant acids such as HCl, $H_2SO_4$, oxalic acid or HF may be used to remove of dissolve the oxide film. Specifically, in the case of titanium, a titanium oxide ($TiO_2$) film is present on the titanium surface. An acid chemical etch is suitable, such as hot concentrated HCl or oxalic acid, to both remove or dissolve the oxide film and to produce a roughened surface on the titanium fiber substrate onto which to plate, for example, platinum metal or to bond a thermal oxide to the surface. The choice of acids depends on the substrate surface texture and surface area required for the electrochemical process application. After the surface oxide is sufficiently etched, the acid is rinsed from the electrode surface using deionized water. Then the etched substrate is immediately placed into the plating bath if an electroless plating operation is used. The acid bath and rinse can be carried out in an inert atmosphere, such as nitrogen or argon, to reduce the amount of any new oxide formation on the surfaces of the etched electrode structure. The deionized water can also be purged with nitrogen before use. For the thermal oxide electrocatalyst surface preparations, acid etching with deionized water rinsing is generally used before the application of the electrocatalyst solutions to the electrode surfaces.

The third step involves the preparation of the electrocatalyst formulations for the coating/plating operation. These include coating or plating solutions containing the electrocatalysts and additives such as precious metal(s), reducing agent(s), and other additives to promote the coating/plating process onto the high surface area electrode substrate.

The electrocatalyst formulation can be in an aqueous or organic solution. A two part electroless platinum plating solution composition and plating process is disclosed in U.S. patent application Ser. No. 07/739,041, filed Aug. 1, 1991.

The fourth process step is the application or bonding of the electrocatalyst to all the components of the fabricated high surface area structure and/or to its individual parts at specified conditions. Such application or bonding may be by electroless plating, thermal coating, or direct electroplating. Other methods of electrocatalyst deposition include vacuum deposition, chemical vapor deposition (CVD), ion beam deposition, and all of their variations.

Metallic coatings are preferably applied by electroless methods since the precious metal deposition is generally much better distributed than that by electrolytic and thermal deposition methods. In electroless plating, the chosen metallic precious metals can be easily directly deposited onto the individual high surface area fiber elements comprising the entire electrode structure electrode under specified temperatures, solution concentrations, pH, and agitation conditions, such as those set forth in U.S. patent application Ser. No. 07/739,041, filed Aug. 1, 1991.

Metal electrocatalysts can also be deposited on the individual metallic or conductive fibers by a direct electroplating procedures in conductive solutions using DC current. The fibers are connected to the negative potential and a dimensionally stable anode is oriented perpendicularly to the fibers during the plating operation in a solution bath. Long lengths of fiber can be mechanically turned and run past the stationary anode to achieve a fairly uniform electrodeposited metallic coating. The metallic coating could then be oxidized thermally or electrochemically to an oxide film if required depending on the type metal deposited, such as ruthenium or lead. The same physical fiber coating process can be used for ion beam, plasma gas, and vacuum metal deposition using a reel to reel set-up in a vacuum chamber where the tow fibers travel under positioned magnetron deposition electrodes to effectively coat almost all of the fiber surfaces. These are all line-of-sight type deposition processes. Chemical vapor deposition (CVD) has the advantage of being able to have a greater depth penetration to coat 3-dimensional high surface area structured materials.

For precious metal oxide thermal coatings, such as for example a ruthenium oxide/titanium oxide coating, the ruthenium and titanium salts in an aqueous/alcohol solution are applied to the completed high surface area electrode structure by painting or dipping, followed by air drying, and then firing at specified temperatures, generally between about 400° to 550° C. with the process repeated up to 10 to 20 times to build up the electrocatalyst layer to the desired thickness.

The fabricated electrode structure can then be employed directly into the electrochemical cell as a removable felt or mat mounted by pressure against a plated current collector, or as a completed electrode structure bonded to the current collector after plating or coating all of its component parts with the selected electrocatalysts.

As a fifth step, post treatment methods may be optionally conducted, if required, to promote adhesion of the coating to the substrate such as by heat annealing, physical consolidation or alloying under vacuum or chemical treatments, a second plating or coating procedure with the same or different metals, such as gold, silver, ruthenium, palladium, etc. Thermal heat treatments are useful for metallic electrocatalyst coatings such as platinum.

These thermal heat treatments, preferably under a high vacuum, are especially useful for preparing metallic, intermetallic or metal alloy electrocatalysts of the metals deposited on and in intimate contact on the surfaces of the high surface area electrode substrate material. Many different intermetallic compounds or alloy electrocatalysts may be formed, such as platinum in combination with other metals such as those in the platinum group metals or with gold, silver or with the group of transition metals in the periodic table. The heat treatment can also form intermetallics or alloys with the electrode base substrate, for example, platinum-titanium alloys. In this case, the surface area of the electrocatalyst on the surface of the substrate will change, but the alloy formed material may have unique electrocatalyst, corrosion and operating life properties that cannot be predetermined.

The performance of a high surface electrode structure in an electrochemical reaction system is related to the physical and chemical aspects of the electrocatalysts on the surfaces of the electrode as well as their placement on those surfaces. For example, the grain or particle size as well as the composition and crystallinity of the electrocatalysts deposited on the surfaces as well as the total surface area of those electrocatalysts have significant effects on the efficiency and selectivity of an electrochemical reaction. The electrocatalyst crystalline orientation on the surface is related to how it is grown on the surface and the action of any crystal growth promoting agents and nucleation forming agents employed in the plating or coating operation. Also important is the long term mechanical and chemical stability of the electrocatalyst on the electrode structure. This is determined by the stability of the electrocatalyst itself in the electrochemical reactions occurring on the electrode surfaces and with the chemical characteristics of the solution environment of the process. Oxidation type anodic electrochemical reactions taking place in strong, hot acidic solutions are the most severe aggressive environments on electrocatalysts and their substrate structures.

The operating current density of the electrochemical process is also an important variable in electrocatalyst life. The strength of the electrocatalyst substrate chemical and physical bonding or interaction is important in obtaining long term active electrode life. For a number of electrocatalysts, the higher the current density, the shorter the electrocatalyst coating life. This is due both to mechanical and chemical mechanisms both on the electrocatalyst and its substrate. In the subject high surface area electrodes, the current density is reduced significantly with the expectation of longer service life.

The fabricated high surface area electrode structure also has the advantage that the electrocatalyst composition can be varied within the electrode structure either in the smaller thickness direction of the electrode or in the direction perpendicular to the thickness of the electrode structure in order to achieve high chemical selectivity and chemical conversions in even single pass flow-through systems. For example, the electrocatalyst in the bottom sections of a porous electrode structure with the solution being fed upflow through the structure can be of a different optimum composition than that in the upper sections of the electrode to compensate for electrochemical reactions because of changes in the composition of the solutions within the structure.

It has been found that a surprisingly small coverage of properly applied electrocatalyst, such as in the range of about 5%-95% on these valve metal high surface area structures is adequate to achieve high electrochemical conversion process performance in a single pass. This reduces the amount and cost of electrocatalyst used in the electrode structure, making it more economical. In addition, the applied electrocatalysts have shown a surprising long-life in long term operation because the high surface area structure has low local operating current density on the porous electrode surfaces. In some electrocatalysts, such as platinum metal, the platinum coating life is proportional to the electrode surface current density. In addition, it has been calculated that the effective surface area of the electrocatalyst deposited on the surfaces of the electrode base structure can be 2-3 times or greater than the actual area of the base electrode structure even at electrocatalyst electrode surface coverages in the range of 30% to 95%. This is because the area of the individual electrocatalyst particles or grains deposited on the surfaces of the electrode, when they are less than about 1-2 microns in diameter at the indicated surface coverages, have a higher surface area than a thin, flat monolayer of electrocatalyst spread on the surface of the electrode. Additionally, multiple layers of electrocatalyst can be applied in different areas of the electrode structure to provide for electrode corrosion resistance or for improving the electrode electrocatalytic performance in a specific process. Also, various parts of the electrode structure can be left uncoated, as for example the current distributor (with it being electrically connected to the porous electrode felt), to have almost all of the electrolytic reactions occur on the high surface area fibers rather than on a portion of the current distributor surface. The type of applied electrocatalyst coatings can be varied in different areas of an individual electrode structure to maximize the desired reactions or also to maximize electrocatalyst life.

For example, the electrode structure may have a platinum metal electrocatalyst in the first bottom half of an upflow electro-reaction system which is subjected to a highly alkaline environment feed, and the upper half of the structure may contain an iridium oxide based electrocatalyst in the upper half of the structure where the pH of the processed solution is more acidic and the electrocatalyst has the preferred reaction product selectivity under these conditions. Thus, the high surface area electrode structure can be fabricated to meet the needs and conditions required for an electrochemical process to be both highly selective and efficient.

The following examples illustrate the novel electrodes of the present invention and the use thereof with no intention of being limited thereby. All parts and percentages are by weight unless otherwise indicated.

EXAMPLE 1

One pound of fine titanium fiber specifically prepared by a melt spin process by Ribbon Technology Corporation, Gahanna, Ohio was placed in a 5 gallon (19 liter) glass tank. The titanium fibers were in the form of ribbons with a thickness of about 0.002 inches (0.00508 cm), a width of about 0.004 inches (0.01016 cm) and individual fiber lengths of about 2 to about 8 inches (5.08 to 20.32 cm) in length. The glass tank with the one pound batch of fibers was placed on top of a hot plate for solution heating. About 10 liters of a 1:1 volume ratio mix of distilled water to about 37% reagent grade hydrochloric acid was added to the tank so that the fibers were totally immersed in the solution. The solution was continually heated until sufficient amounts of hydrogen bubbles evolved from the titanium surfaces of the fibers and the solution began turning blue because of the formation of soluble titanium trichloride from the titanium that dissolved from the surfaces of the fibers. This occurred at about 50° C. after about 20 minutes of heating. The acid etching was continued for another 20 minutes until the evolution of hydrogen was uniform from the fiber surfaces and the titanium fiber surfaces had turned slightly gray upon visual inspection. The fiber batch was then removed from the acid bath and quickly rinsed in deionized water.

A two part platinum plating solution was prepared from about 339 ml of a chloroplatinic acid solution containing about 16.95 gm (0.545 troy oz. or 0.08688 gm-moles) of platinum metal. The chloroplatinic acid solution was diluted to about 3 liters with deionized water and pH adjusted with dilute 5% sodium hydroxide to a pH value of about 2.0. The second part of the plating solution containing the platinum reducing agent was prepared by dissolving about 1000 gm (2.205 lb or 14.38 gm-moles) of reagent grade hydrazine dihydrochloride crystal in about 5 liters of deionized water. Both solutions were mixed with an additional 2 liters of deionized water to obtain about 10 liters of an orange-yellow colored electroless platinum plating solution. The solution contained about 1.70 gm/l of platinum metal and had a 165:1 molar ratio of reducing agent to platinum.

The rinsed fibers were then put into another glass tank with an external hot plate and immersed into the 10 liter electroless platinum plating solution, initially having an ambient temperature of about 25° C. and then heated. Nitrogen gas bubbles were immediately evolved from the surface of the fibers upon addition to the electroless bath. This indicated the plating of platinum onto the surfaces of the fibers. The bubble evolution decreased to small amounts after about 30 minutes as the solution temperature slowly increased. The loss of the orange-yellow color to a water color in the plating solution is an indication of the extent of the completion of the platinum plating. Verification of the presence of residual platinum in the plating bath was done by taking samples of the plating solution and making the sample alkaline by the addition of 10% NaOH. A black precipitate indicated some residual platinum was left in the plating bath.

The plating solution with the fibers was heated to a temperature of about 100° C. There were still significant amounts of platinum in the plating solution at the end of 4 hours. The plating bath was kept at that temperature overnight for a total time of about 16 hours. At the end of 16 hours there was no soluble platinum left in the plating solution. The plating was therefore completed sometime in the time period of between 4 to 16 hours. The plated titanium fibers had a dull metallic luster. If a thin, continuous layer of platinum were deposited on the titanium fibers, the calculated coating thickness of the platinum was estimated to be about 0.13 microns.

Scanning electron microscopy (SEM) examination of the plated titanium fibers showed a fairly smooth titanium surface base structure with a scattered surface coverage of approximately spherical shaped platinum grains having diameters in a size range of about 0.25 to about 0.75 microns. The actual surface was not the expected smooth, even platinum layer coated on the titanium.

EXAMPLE 2

A second one pound batch of the titanium fiber lot was placed in a 5 gallon (19 liter) glass tank on top of a hot plate for solution heating. There was about 10 liters of a stronger 1:2 volume ratio of distilled water to about 37% reagent grade hydrochloric acid etchant mixture added to the tank so that the fibers were totally immersed in the solution. The solution was continually heated until sufficient amounts of hydrogen bubbles evolved from the surfaces of the titanium fibers and the solution began turning a deep blue color from the soluble titanium trichloride that dissolved from the surfaces of the fibers. This occurred at about 50° C. after about 10 minutes. The acid etching was continued for about another 20 minutes until the surfaces of the titanium fibers had turned gray upon visual inspection. The fiber batch was then removed from the acid bath and quickly rinsed in deionized water.

The same composition two part 10 liter volume platinum plating solution containing about 16.95 gm (0.545 troy oz.) of platinum metal and about 1000 gm of hydrazine dihydrochloride was prepared exactly as in Example 1, except that the plating solution was preheated to about 50° C. The deionized water rinsed titanium fibers were then put into the preheated 10 liters of the electroless platinum plating solution with heat applied. Nitrogen gas bubbles were immediately evolved from the surface of the fibers upon addition to the electroless bath, indicating the plating of platinum onto the surfaces of the fibers. The bubble evolution decreased to small amounts after about 30 minutes as the solution temperature slowly increased. The plating solution with the fibers was heated to a temperature of about 100° C. and kept at that temperature overnight for a total time of about 18 hours. There was no soluble platinum found in the plating solution at the end of the 18 hours. The plating was complete sometime in the time period of between 5 to 18 hours. The plated titanium fibers had a dull, medium gray color.

The SEM examination of the plated titanium fibers showed a roughened, honeycomb-type titanium surface base structure with the inside and outside honeycomb surfaces covered with a scattering of approximately spherically shaped platinum grains having diameters in a size range of about 0.50 to about 0.75 microns.

EXAMPLE 3

The same 10 liters of the same 1:2 volume ratio of distilled water to about 37% reagent grade hydrochloric acid etchant mixture in a 19 liter glass tank used in Example 2 was used to etch a third one pound batch of the titanium fiber lot. The etching solution was already hot at about 60° C. The titanium fibers began evolving hydrogen in about 10 minutes. The acid etching of the fibers has continued until the surfaces of the titanium fibers had turned gray upon visual inspection. The fiber batch was then removed from the acid bath and quickly rinsed in deionized water.

The same composition two part 10 liter volume platinum plating solution containing about 16.95 gm (0.545 troy oz.) of platinum metal and about 1000 gm of hydrazine dihydrochloride was prepared exactly as in Example 2, except that the plating solution was preheated to about 70° C. The deionized water rinsed titanium fibers were then put into the preheated 10 liters of the electroless platinum plating solution with heat applied. Nitrogen gas bubbles were immediately evolved from the surface of the fibers upon addition to the electroless bath, indicating the plating of platinum onto the surfaces of the fibers. The bubble evolution decreased to small amounts after about 30 minutes as the solution temperature slowly increased. The plating solution with the fibers was heated to a temperature of about 100° C. and kept at that temperature overnight for a total time of about 16 hours. There was no soluble platinum in the bath at the end of 16 hours. The plating was completed sometime in the time period of between 3 to 16 hours. The plated titanium fibers had a dull, medium gray color.

The SEM examination of the plated titanium fibers showed a similar roughened, honeycomb-type titanium surface base structure as in Example 2 with the inside and outside honeycomb surfaces covered with a scattering of approximately spherically shaped platinum grains, but with the grains having diameters in a size range of about 0.50 to about 0.70 microns.

EXAMPLE 4

The three one pound lots of platinum plated titanium fiber prepared in Examples 1-3 were hand laid into a metallic felt and used as flow-through anode structure in an electrochemical cell to oxidize dilute aqueous solutions of sodium chlorite to chlorine-free chlorine dioxide solutions. The dilute aqueous solutions of sodium chlorite contained conductive salts.

A two compartment electrochemical cell was constructed similar to that shown in FIG. 1 of the above mentioned U.S. patent application, Ser. No. 07/739,041 from about 1.0 inch (2.54 cm) thick type 1 PVC (polyvinyl chloride). The outside dimensions of both the anolyte and catholyte compartments were about 42 inches (1.067 meters) by about 42 inches with internal machined dimensions of about 39 inches (0.9906 meters) wide by about 39 inches long and a recess depth of about 0.375 inches (0.9525 cm) for the anode compartment and about 0.185 inches (0.470 cm) for the cathode compartment.

The anode compartment was fitted with about a ¼" (0.635 cm) thick by about 38.875 inch (0.987 meters)

wide by about 38.875 inch (0.987 meters) long ASTM grade 2 titanium plate current distributor with nine ¾" (1.905 cm) titanium conductor posts welded to the backside mounted on 13 inch centers and routed through matched holes drilled into the anolyte PVC frame. The titanium anode plate was glued or sealed into the inside anode recess using two layers of about a 0.005 inch (0.0127 cm) loose open weave fiberglass mat for adhesive support and a silicone based sealant/adhesive to prevent any solution flow behind the anode. Polypropylene ¾ inch NPT (national pipe thread) to ¾ inch tubing fittings were used to seal the titanium conductor posts on the backside of the PVC anode compartment.

The titanium surface was then abraded with rough sandpaper and chemically etched with concentrated hydrochloric acid for about 10 to about 15 minutes until the surface was grayish in color and then rinsed with deionized water. The top of the titanium current distributor plate surface was then immediately brush electroplated to obtain about a 1.19 micron (46.9 microinch) thick platinum coating using 500 ml of chloroplatinic acid solution containing about 25 gm (0.804 troy oz.) of platinum metal equivalent.

The three pounds of platinum plated titanium felt was then placed into the approximately ⅛ inch (0.3175 cm) recess above the mounted platinum plated anode current distribution plate. The metallic felt, when finally compressed during cell assembly, had a calculated specific surface area of about 57 cm2/cm3 with a fill density of about 9.7% in the recessed area.

The PVC catholyte compartment was fitted with a 0.060 inch (0.1524 cm) thick by 38.875 inches (0.987 meters) wide by 38.875 inches (0.987 meters) long perforated plate made of type 316 L stainless steel having ⅛ inch (0.3175 cm) holes set on a ⅛ inch stagger with about a 41% open area. The perforated plate had nine ¾ inch (1.905 cm) 316 stainless steel conductor posts welded to its backside, mounted on 13 inch centers and routed through matched holes drilled into the catholyte PVC frame. Two layers of about 1/16 inch (0.1588 cm) thick polypropylene mesh with about ¼ inch (0.635 cm) square holes were mounted under the stainless steel cathode to position the cathode approximately flush with the surface of the compartment and to provide for hydrogen gas and sodium hydroxide liquid disengagement from the compartment. Polypropylene ¾ inch NPT to ¾ inch tubing fittings were used to seal the 316 stainless conductor posts on the backside of the PVC anode compartment.

The electrochemical cell assembly was completed using about a 0.040 inch (0.1016 cm) thick polytetrafluorethylene compressible GORE-TEX® gasket tape, available from W. L. Gore & Associates, on the sealing surfaces of the cell frames. A DuPont NAFION® 417 polytetrafluorethylene fiber reinforced perfluorinated sulfonic acid cation permeable type membrane was then mounted between the anolyte and catholyte compartments. Two approximately 1.0 inch (2.54 cm) thick steel end plates with appropriate holes for the conductor posts were then used to compress the cell unit using ⅞ inch (2.223 cm) threaded steel tie rods, nuts, and spring washers.

The following test run performance data was obtained with the above electrochemical cell unit assembly as given in TABLE I. The concentrated cell feed was prepared by mixing about a 26 percent by weight sodium chloride and about a 25 percent by weight sodium chlorite solution in a 1:1 weight ratio. The concentrated formulated feed solution was then diluted with softened water to obtain a dilute feed solution concentration of about 9.61 gm/l as NaClO2. The diluted feed was metered into the cell anolyte compartment at the flowrates listed in TABLE I. The applied amperage was adjusted as given to obtain the desired output chlorine dioxide solution product pH of about 3.0 at each flowrate. As can be seen, at a feed flowrate of 0.75 liters per minute, the chlorite to chlorine dioxide conversion was about 96.4%. As the flowrate was increased to about 2.5 liters per minute, the chlorite to chlorine dioxide conversion percentage decreased to about 86.8% at the indicated solution pH values and amperage settings. TABLE I also lists the chlorine dioxide production rate at each flowrate as well as the electrical operating cost in $/DCKWH per pound of chlorine dioxide produced.

TABLE I

ONE SQUARE METER ELECTROCHEMICAL CHLORINE DIOXIDE GENERATOR CELL TRIAL PERFORMANCE RESULTS

ANODE TYPE: 4 MIL DIAMETER PLATINUM PLATED TITANIUM FIBER FELT

| FORMULATED SODIUM CHLORITE FEED FLOWRATE L/MIN | CELL AMPERAGE IN AMPS | CELL VOLTAGE IN VOLTS | ClO2 PRODUCT SOLUTION PH | ClO2 PRODUCT SOLUTION GPL ClO2 | CHLORITE TO ClO2 CONVERSION % EFFICIENCY | ClO2 PRODUCTION RATE-LB/HR | OPERATING COST $/LB ClO2 |
|---|---|---|---|---|---|---|---|
| 0.75 | 141 | 2.57 | 3.05 | 6.91 | 96.4 | 0.69 | $0.029 |
| 1.00 | 187 | 2.68 | 3.08 | 6.86 | 95.7 | 0.91 | $0.030 |
| 1.25 | 234 | 2.81 | 3.01 | 6.81 | 95.0 | 1.13 | $0.032 |
| 1.50 | 280 | 2.90 | 3.08 | 6.60 | 92.4 | 1.31 | $0.034 |
| 2.00 | 362 | 3.10 | 3.06 | 6.44 | 89.8 | 1.69 | $0.037 |
| 2.50 | 452 | 3.22 | 3.03 | 6.22 | 86.8 | 2.06 | $0.039 |

NOTES:
1. TEST CONDUCTED WITH 9.61 GPL CONCENTRATION NACIO2 IN FORMULATED FEED. MAXIMUM THEORETICAL ClO2 CONCENTRATION = 7.17 GPL ClO2
2. POWER COST AT $0.055/DCKWH

EXAMPLE 5

An electrochemical cell was constructed similar to that of FIG. 1 of the above mentioned U.S. patent application Ser. No. 07/739,041 consisting of two compartments machined from about 1 inch thick PVC (polyvinyl chloride). The outside dimensions of both the anolyte and catholyte compartments were about 5 inches (12.7 cm) by about 14 inches (35.56 cm) with machined internal dimensions of about 3 inches (7.62 cm) by about 12 inches (30.48 cm) by about ⅛ inch (0.3175 cm) deep.

The anolyte compartment was fitted with a 1/16 inch (0.1588 cm) thick by about 3 inch (7.62 cm) by about 12 inch (30.48 cm) titanium plate having a 0.25 inch (0.635 cm) diameter titanium conductor post on the back side and a 100 microinch (2.54 micron) platinum electroplated surface on the front side. The titanium anode plate was glued or sealed into the inside anode recess with a silicone based adhesive to prevent any solution flow behind the anode. A platinum plated high surface area metallic felt prepared as described below was then placed into the 1/16 inch (0.1588 cm) recess above the mounted anode plate.

The high surface area metallic felt was prepared from about 8 grams of a 12 micron (0.00047 inch) diameter multi-filament titanium tow fiber obtained from Bekaert Corporation (Marietta, Ga.) which was hand pulled and laid to form a metallic felt with long fibers (about 0.5 to about 6 inches or about 1.27 to about 15.24 cm) into about a 3 inch (7.62 cm) wide by about 12 inch (30.48 cm) long physical form similar to glass wool. The metallic fibers in the prepared felt were acid etched with about 30 percent by weight hot concentrated HCl (about 50° C.) for about 15 minutes until there was sufficient hydrogen bubble release from the titanium fibers and the fiber surfaces turned a light gray color. Care was taken to not etch the fibers excessively because of their small diameter size. The titanium felt was then quickly rinsed in deionized water and folded into a one liter beaker on top of a hot plate/magnetic stirrer. Then about 800 ml of a prepared two part electroless platinum plating solution was immediately poured into the beaker.

The plating solution was prepared by diluting about 30 ml of a chloroplatinic acid solution containing about 5 grams of platinum metal per 100 ml solution into a 200 ml volume with deionized water for a total of about 1.5 grams (0.02563 gm-moles) of platinum metal. The solution was then pH adjusted with about 5 percent by weight NaOH to obtain a pH of about 2.0. The second part of the two part plating solution is a reducing agent solution that was prepared by dissolving about 50 grams (0.719 gm-moles) of hydrazine dihydrochloride in crystal in about 600 ml of deionized water. These two solutions were then mixed to obtain the electroless platinum plating solution containing about a 28:1 molar ratio of reducing agent to platinum metal.

The ambient temperature (about 25° C.) platinum plating solution with the etched titanium fibers was then heated and the solution stirred using a magnetic stirring bar in an open area below the felt. Nitrogen bubbles were released immediately on contact with the solution. The plating solution temperature was quickly heated to about 60° to about 70° C. in about 20 minutes. The plating solution became a clear, water color in about one hour. An alkaline precipitation test showed no residual platinum in the plating solution. The platinum plated felt mat was then rinsed in deionized water, air dried, and then mounted as described above into the 1/16 inch anode recess area.

The thickness of the platinum film coating deposited on the fibers was estimated to be about 0.16 microns from the about 1.5 grams of platinum metal equivalent deposited in the plating process. The final felt structure had a calculated specific surface area of about 160 $cm^2/cm^3$ with a fill density of about 4.8% in the recess area. Examination of the platinum plated titanium fiber surfaces with a Scanning Electron Microscope (SEM) showed spherical platinum crystallites deposited on the surfaces and in the acid etched grooves of the titanium fibers. The diameter of the spherical platinum crystallites appeared to be about a 0.3 to about 0.6 microns. Surface coverage of the fibers with the platinum crystallite spheres was estimated to be between about 40 to about 60 percent of the individual fiber surfaces. The depth of the etched grooves in the titanium fibers was estimated to range between about 0.5 to about 2.5 microns, depending on individual fiber etching rates.

The catholyte compartment was fitted with about a 1/16 inch (0.1588 cm) thick by about 3 inch (7.62 cm) by about 12 inch (30.48 cm) type 316L stainless steel perforated plate having about a 0.25 inch (0.635 cm) diameter 316L stainless steel conductor post on the back side. The cathode plate was mounted into the inside anode recess with about a 1/16 inch (0.1588 cm) thick expanded polytetrafluorethylene mesh behind the cathode plate into order to have the cathode surface flush with the inside surface of the anolyte compartment.

The electrochemical cell assembly was completed using about 0.020 inch (0.0508 cm) thickness polytetrafluorethylene compressible GORE-TEX ® gasket tape, available from W. L. Gore & Associates, on the sealing surfaces of the cell frames. A DuPont NAFION ® 117 nonreinforced perfluorinated sulfonic acid cation permeable type membrane was then mounted between the anolyte and catholyte compartments.

The following test runs were conducted with the assembled electrochemical cell unit. In this set of tests, about a 25 percent by weight sodium chlorite concentrated feed containing about 4 percent by weight NaCl with a $NaCl:NaClO_2$ weight ratio of about 0.16:1 was diluted in deionized water to obtain about a 9.90 gpl concentration of sodium chlorite containing about 1.6 gpl NaCl. The base diluted feed was used as is, or with the indicated addition of NaCl or $Na_2SO_4$ to the feed as indicated to demonstrate the enhanced chlorite to chlorine dioxide conversion performance of the electrochemical cell with the added conductive salt. The combined total conductive salts to $NaClO_2$ weight ratios in these tests were equal to about 0.57:1 for both the NaCl and $Na_2SO_4$ feed addition runs.

The various chlorite feeds were metered into the anolyte compartment of the cell at a mass feedrate of about 21 grams/minute. A softened water flow of 10 ml/minute was metered into the catholyte compartment to produce dilute by-product NaOH. The applied cell amperage was varied and the cell voltage, output pH, and chlorine dioxide concentration were monitored. The chlorine dioxide solution concentration was monitored with a special design spectrophotometer utilizing a 460 nanometer wavelength that was calibrated for use in this high chlorine dioxide solution concentration range. The chlorine dioxide concentrations were also periodically checked by iodometric titration. Several of the product solution samples were analyzed for chlorite and chlorate ion residuals after the chlorine dioxide was air sparged from the solution product.

The results are listed in TABLE II.

TABLE II

DIRECT ELECTROCHEMICAL CHLORINE DIOXIDE GENERATOR EXPERIMENTAL TEST RUNS

TEST CELL: 12 MICRON DIAMETER PT PLATED TITANIUM FELT ANODE-EFFECT OF ADDED SALTS TO CHLORITE FEED SOLUTION ON CELL PERFORMANCE-

| FEED GPL | FLOWRATE GM/MIN | CELL VOLTS | CELL AMPS | PRODUCT ClO2 PH | PRODUCT ClO2 GPL | CONVERSION % | RESIDUALS IN CONCENTRATE PRODUCT SOLUTION ClO2- GPL | RESIDUALS IN CONCENTRATE PRODUCT SOLUTION ClO3- GPL |
|---|---|---|---|---|---|---|---|---|
| NO ADDITIONAL SALTS ADDED TO BASE FEED: | | | | | | | | |
| 9.90 | 21.00 | 2.25 | 1.74 | 8.55 | 3.91 | 52.96 | | |
| 9.90 | 21.00 | 2.36 | 2.27 | 7.88 | 5.01 | 67.85 | | |
| 9.90 | 21.00 | 2.44 | 2.62 | 6.94 | 5.68 | 76.93 | | |
| 9.90 | 21.00 | 2.62 | 3.18 | 6.64 | 6.39 | 86.54 | | |
| 9.90 | 21.00 | 2.97 | 3.59 | 2.35 | 6.42 | 86.95 | | |
| 9.90 | 21.00 | 3.10 | 4.24 | 2.08 | 5.87 | 79.50 | | |
| 4 GPL NACL ADDED TO BASE FEED: | | | | | | | | |
| 9.90 | 21.00 | 2.20 | 1.74 | 8.39 | 4.09 | 55.39 | | |
| 9.90 | 21.00 | 2.28 | 2.24 | 7.45 | 5.35 | 72.46 | | |
| 9.90 | 21.00 | 2.34 | 2.57 | 7.26 | 5.81 | 78.69 | | |
| 9.90 | 21.00 | 2.44 | 3.10 | 6.37 | 6.77 | 91.69 | 0.84 | 0.65 |
| 9.90 | 21.00 | 2.51 | 3.54 | 4.72 | 7.26 | 98.33 | 0.24 | 0.83 |
| 9.90 | 21.00 | 2.83 | 4.09 | 2.04 | 7.02 | 95.08 | | |
| 9.90 | 21.00 | 2.94 | 4.58 | 1.67 | 6.44 | 87.22 | | |
| 9.90 | 21.00 | 3.08 | 5.43 | 1.41 | 5.09 | 68.94 | | |
| 4 GPL NA2SO4 ADDED TO BASE FEED: | | | | | | | | |
| 9.90 | 21.00 | 2.29 | 2.09 | 8.57 | 4.51 | 61.08 | | |
| 9.90 | 21.00 | 2.37 | 2.58 | 7.45 | 5.55 | 75.17 | | |
| 9.90 | 21.00 | 2.50 | 3.17 | 6.50 | 6.65 | 90.07 | | |
| 9.90 | 21.00 | 2.75 | 3.62 | 2.62 | 7.21 | 97.65 | 0.00 | 1.18 |
| 9.90 | 21.00 | 2.91 | 4.08 | 1.99 | 6.59 | 89.25 | | |
| 9.90 | 21.00 | 3.04 | 4.58 | 1.63 | 5.46 | 73.95 | | |

EXAMPLE 6

The same electrochemical cell as in example 5 was used to evaluate the platinum plated titanium fibers made as described below.

About 20 grams of a 12 micron (0.00047 inch) diameter single length multi-filament titanium tow fiber (obtained from Bekaert Corporation) containing about 500 filaments was cut from a large continuous spool. The tow fiber was then hot acid etched in about 20 percent by weight HCl at about 50° C. in a 1000 ml beaker. The beaker was placed on a hot plate for about 15 minutes until the hydrogen gas bubble evolution from the fibers was uniform and the fibers turned a light gray color. Care was taken to not etch the fibers excessively because of their small diameter size. The etched titanium tow fiber was then quickly rinsed in deionized water and placed into a premixed about 800 ml volume of platinum plating solution in a one liter beaker on top of a hot plate/magnetic stirrer. The premixed platinum plating solution contained about 60 ml of a chloroplatinic acid solution containing about 5 grams of platinum per 100 ml for a total of about 3.0 grams (0.05126 gm-moles) of platinum metal and about 20 grams (0.2876 gm-moles) of hydrazine dihydrochloride crystal. This solution had a ratio of reducing agent to platinum of about 5.6:1.

The nitrogen bubble evolution and platinum solution color change increased dramatically at a temperature of about 55° C. to about 60° C. The plating solution turned from yellow-orange to colorless in less than 15 minutes. No residual platinum was noted in the plating solution with the hydroxide addition test. The platinum plated titanium tow fiber was then washed with deionized water and then air dried.

The SEM examination of the platinum plated titanium fiber surfaces showed about 0.3–0.5 micron diameter spherical platinum crystallites deposited on the surfaces and in the acid etched grooves of the titanium fibers. Surface coverage of the fibers with the platinum crystallite spheres was estimated to be between about 60 to about 80 percent of the surfaces of the individual fibers. The depth of the etched grooves in the titanium fibers was estimated to range between about 0.5 to about 1.5 microns depending on individual fiber etching rates.

There was about 10 grams of the tow fiber was then cut into 12 inch lengths which were pulled apart by hand and laid to form a metallic felt about 3 inches (7.62 cm) wide by about 12 inches (30.48 cm) long. The platinum plated felt mat was then mounted as described above in Example 5 into the 1/16 inch anode recess area. The cell chlorite to chlorine dioxide conversion efficiency performance was similar to that of Example 5.

EXAMPLE 7

The same plating procedure was done as in Example 6 except that a higher concentration of platinum was used.

There was about 20 grams of a 12 micron (0.00047 inch) diameter single length multi-filament titanium tow fiber (obtained from Bekaert Corporation) containing about 500 filaments cut off a large continuous spool. The tow fiber was then hot acid etched in 20 percent by weight HCl at a temperature of about 50° C. in a 1000 ml beaker. The beaker was placed on a hot plate for about 15 minutes until the hydrogen gas bubble evolution from the fibers was uniform and the fibers turned a light gray color. Care was taken to not etch the fibers excessively because of their small diameter size. The etched titanium tow fiber was then quickly rinsed in deionized water and placed into about 800 ml volume of a premixed platinum plating solution in a one liter beaker on top of a hot plate/magnetic stirrer. The premixed platinum plating solution contained about 80 ml of a chloroplatinic acid solution containing about 5 grams of platinum per 100 ml for a total of about 4.0 grams (0.0683 gm-moles) of platinum metal and about 30 grams (0.4314 gm-moles) of hydrazine dihydrochloride crystal. This solution had a ratio of reducing agent to platinum of about 6.3:1.

The nitrogen bubble evolution and platinum solution color change increased dramatically at a temperature of about 55° to about 60° C. The plating solution turned from yellow-orange to colorless in less than 15 minutes. No residual platinum was noted in the plating solution with the hydroxide addition test. The platinum plated titanium tow fiber was then washed with deionized water and then air dried.

The SEM examination of the platinum plated titanium fiber surfaces showed individual spherical platinum crystallites of about 0.4 to about 1.2 micron diameter that were both cocrystallized and attached to each other and onto the surfaces of the titanium fibers. Surface coverage of the fibers with the platinum crystallite spheres was estimated to be between about 75 to about 90 percent of the surfaces of the individual fibers. The depth of the etched grooves in the titanium fibers was estimated to range between about 0.5 to about 1.2 microns depending on individual fiber etching rates.

EXAMPLE 8

This example describes the fabrication of a 60 $cm^2/cm^3$ specific surface area platinum coated high surface area flow-through anode structure for the electrochemical anodic oxidation of hypochlorous acid to produce chloric acid comprising an electroless platinum plated sintered titanium metal fiber felt panel spot welded onto a platinum electroplated titanium current distributor plate.

A 10% density, 40 inch (101.6 cm) by 40 inch by 0.125 inch (0.3175 cm) thick sintered titanium fiber panel was fabricated from melt spun titanium fibers obtained from Ribbon Technology Corporation. The panel was prepared using melt-spun fibers with a cross section diameter of 0.002 inches (0.00508 cm) by 0.004 inches (0.0102 cm) with fiber lengths ranging between 4 inches (10.16 cm) to 8 inches (20.32 cm) long with an average length of about 6 inches (15.24 cm). The calculated length to diameter aspect ratio range of these fibers ranged from 1000 to 4000 depending on the values used for the fiber diameter and length combinations. The titanium fibers were laid and evenly distributed to form a felt mat containing 3.25 lbs (1.474 kg) of fiber. The titanium fiber felt was then compressed under a static load between inert plates with compression load stop spacers, and then sintered in a high vacuum furnace at a temperatures greater than 1500° F. (816° C.) for more than 4 hours. The sintered panel was then calendered to obtain the 0.125 inch thickness specification. A panel 60 cm (23.62 inches) long by 20 cm (7.87 inches) wide and a thickness of 0.3175 cm (0.125 inches) was cut from the sheet for installation into the 0.12 square meter test cell.

The cut panel was again cut in half into two 30 cm long by 20 cm wide panels and were separately electrolessly plated with metallic platinum. The cut panels were placed in a hot 60° C. bath containing 30 wt % HCl until the panels turned gray and evolved an even dispersion of hydrogen bubbles from their surfaces (in about 20–40 minutes with the solution having a blue color). The panels were then quickly rinsed with deionized water and individually immersed into preheated (50° C.) solutions of premixed 300 mL volumes of electroless platinum plating solutions in rectangular glass dishes.

The plating solution was prepared by diluting 106 mL of chloroplatinic acid containing 5.0 gm platinum metal per 100 mL of solution (5.3 gm Pt metal total) with deionized water to make a 300 mL volume solution. The solution was pH adjusted to about a pH of 2.0 with 10 wt % NaOH. The second part of the electroless bath mixture was prepared by dissolving 45 gm of hydrazine dihydrochloride into deionized water to make a 300 mL volume solution. The solutions were mixed for a volume of 600 ml and divided into two equal 300 mL portions for plating the panels. Additional water was added to the solutions as required to cover the panels completely with the plating solution.

The panels were plated with agitation at temperatures between 60°–90° C., with the plating completed in about 45 minutes or less. The panels were then rinsed in deionized water, then rinsed with dilute 1 wt % NaOH to neutralize any residual acidity in the panel, followed with a final rinse with deionized water. The panels had a dull, metallic luster after air drying. A quick SEM examination of titanium fibers from the panels showed spherical platinum grains distributed on the fiber surfaces with diameters between 0.2–0.75 microns and having an estimated fiber surface coverage of more than 60%.

The platinum plated titanium panels were then butted together and spot welded with a Miller WT-1515 spot welder using a mechanical compression force onto a 0.25 inch (2.79 cm) thick platinum-plated titanium anode current distributor backplate. A copper spot welding tip having a diameter of about 0.125 inches (0.3175 cm) under a helium gas protective shield was used with an applied 60% current setting. The spot welding pattern had 28 weld points, evenly spaced about 2.5 inches (6.35 cm) apart. The metallic felt panel was in both excellent mechanical and electrical contact with the current distributor plate. The platinum coating on the titanium backplate surface was made by chemically pretreating the surface of the plate with 35 wt % HCl for 10–20 minutes, followed by deionized water rinsing, and then evenly brush-electroplating a platinum electrocatalyst surface coating using 60 mL of chloroplatinic acid solution containing 5 gm Pt/100 mL solution.

The completed anode structure was then mounted in a cell assembly consisting of a two compartment cell separated by a NAFION® 417 membrane. The cathode was of the same projected surface area as the anode and was made of HASTELLOY® C-22 a nickel based wrought alloy wire mesh, 6 holes per inch. Both chambers were between 1/16 and ⅛ inches in depth. A KYNAR® brand polyvinylidienedifluoride (PVDF) material was used in a flow distribution plate. The two chamber halves were sealed with blue gylon and GORE-TEX® gasketing materials. Holes were drilled into the top and bottom of each chamber (4 sets total) to allow for flow into and out of the chambers. The anode and cathode backplates were both ¼×10×32 inches and were made of ASTM Grade 2 Titanium and HASTELLOY® C-22, respectively. Both plates contained tabs for connecting rectifier leads. The 20×60 cm anode and cathode pieces were centered and spot welded to their respective backplates. The two chamber halves were pieced together in a filter press arrangement and included the internal chamber parts, membrane, gaskets, backplates, insulating plates and distribution plates.

Both anolyte and catholyte solutions were recirculated by pumps in independent loops through their respective chambers. The anolyte was a chloric acid solution in 10% to 35 wt % concentration and it also contained unreacted HOCl. The catholyte was HCl solution up to 10 weight percent concentration. Both anolyte and catholyte recirculation loops contained gas-liquid disengagers of about 2 liter capacity each to allow for separation of gases from the system formed within the cell. These gases included oxygen and chlorine from the anolyte chamber and hydrogen and chlorine from the cathode chamber. The anolyte and catholyte vent gases were collected by different sources to avoid mixing oxygen and hydrogen gases. The two system volumes were about 2.5–3 liters and 0.5–1.0 liters capacity for the anolyte and catholyte solutions, respectively. The anolyte loop contained a heat exchanger to control anolyte temperature in the cell. The recirculation rates were about 1–4 gallons per minute for both anolyte and catholyte solutions. The HOCl was fed into the top of the anolyte disengager at the rate of about one hundredth the anolyte recirculation rate in gallons per minute. No material was fed into the catholyte recirculation loop. The anolyte rate was not the same as the HOCl feed rate since some anolyte material migrated across the membrane into the catholyte and the anolyte and catholyte solutions both evolved gases for additional weight loss. The chloric acid product was collected from the anolyte disengager overflow. Some HCl solutions was collected from the catholyte disengager overflow.

The cell performance ratio for four different runs on four different days using the above-described arrangement of this Example 8 is set forth in TABLE III, runs 1–6. Runs 1,2,3 and 4 were all conducted at a projected area operating current density of 4 $KA/m^2$. Runs 5 and 6 were conducted at 6 $KA/m^2$ and 8 $KA/m^2$ respectively and showed very little change in the electrolytic process HOCl conversion, $HClO_3$ yield and current efficiency parameters in comparison to runs 1–4 at 4 $KA/m^2$. This electrolytic cell operating performance even at high current densities demonstrates the utility of the electrode structure for electrolytic process applications.

EXAMPLE 9

This example describes the fabrication of a high surface area flow-through anode structure for the electrochemical anodic oxidation of hypochlorous acid to produce chloric acid comprising a ruthenium oxide coated titanium metal fiber felt spot welded onto a ruthenium oxide coated titanium plate current distributor.

Nine individual titanium fiber high surface area felt pads with a density of about 13.5% and specific surface area of about 80 $cm^2/cm^3$ were prepared using 50 gm quantities of the same melt-spun titanium fibers as in Example 8. The titanium fiber felt pads were made by hand laying the fibers into a 2.5 inch (6.35 cm) by 16 inch (40.64 cm) steel die and compressing the fibers into a pad form with an approximate 0.125 inch (0.3175 cm) thickness using about 25,000 psig pressure with a hydraulic piston pressure press. The metallic pads were then immersed in a 30 wt % HCl solution for about 20 minutes to remove any surface metallic impurities such as iron, and then thoroughly rinsed in deionized water. The nine compressed felt pads were then cut into 20 cm lengths and positioned onto a 0.250 inch (0.635 cm) thick titanium anode current distributor backplate in the central 20 cm wide by 60 cm long active anode area. The pads were then spot welded to the titanium backplate with a Miller WT-1515 spot welder at numerous points, at about 0.250 inch centers using a 1/16 inch (0.159 cm) diameter post welding tip electrode under a compression force against the felt pad and the plate under a helium gas shield using a 60% to 80% welding current output. The metallic felt pads were in both excellent mechanical and electrical contact with the anode current distributor plate.

An anode electrocatalyst coating solution was then prepared by dissolving about 30 gm of ruthenium trichloride monohydrate crystal in 780 mL of 2-propanol and then mixing in a 120 mL volume of 10 wt % HCl in deionized water into the solution. One-half of the solution volume was carefully brushed onto the felt pad surface of the anode structure in combination with heating the surface with a hot air gun to drive off the solvents, leaving behind the ruthenium salt(s) on the surfaces of the felt pad and the underlying backplate surface. After all of the solution was applied, the coating was hot air dried, and then the entire anode structure was placed into a kiln at 450° C. for 15 minutes in air. The anode structure was then removed, cooled to room temperature, and the application and air drying procedure was repeated using the remaining quantity of electrocatalyst precursor solution. The anode structure was then placed in the kiln for about 4 hours at 500° C. for the final ruthenium oxide electrocatalyst coating activation.

The high surface area ruthenium oxide coated anode structure was then mounted in the same cell assembly as in Example 8. The cell performance data for two runs on two separate days using the arrangement of this Example 9 is set forth in TABLE III as runs 7 and 8.

TABLE III

| CELL PERFORMANCE INDICATOR | RUN 1 | RUN 2 | RUN 3 | RUN 4 | RUN 5 | RUN 6 | RUN 7 | RUN 8 |
|---|---|---|---|---|---|---|---|---|
| $HCLO_3$ YIELD | 35 | 40 | 42 | 39 | 40 | 42 | 41 | 50 |
| HOCL CONVERSION | 92 | 88 | 79 | 82 | 89 | 85 | 86 | 88 |
| CURRENT EFFICIENCY | 69 | 73 | 72 | 68 | 68 | 70 | 31 | 34 |
| CELL VOLTAGE | 2.92 | 3.15 | 3.32 | 3.06 | 3.80 | 4.29 | 3.41 | 4.25 |
| $HCLO_3$ CONCENTRATION | 20 | 22 | 17 | 16 | 18 | 17 | 26 | 28 |
| CELL TEMPERATURE | 60 | 40 | 20 | 40 | 40 | 40 | −7 | −12 |
| CURRENT DENSITY | 4.0 | 4.0 | 4.0 | 4.0 | 6.0 | 8.0 | 3.0 | 3.0 |
| HOCL FEED CONCENT. | 22 | 22 | 20 | 20 | 20 | 20 | 20 | 17 |
| FEED RATE (LB/HR) | 9.1 | 7.8 | 8.5 | 9.2 | 11.6 | 15.8 | 2.6 | 2.4 |
| ANOL RATE (LB/HR) | 6.6 | 5.7 | 6.2 | 6.6 | 8.1 | 11.1 | 1.1 | 1.2 |

While the invention has been described above with reference to various embodiments, it is apparent that many changes, modifications and variations can be made without departing from the inventive concept disclosed. Accordingly, it is intended to embrace all such changes, modifications and variations that fall within the spirit and broad scope of the appended claims. All patents, patent applications and other publications which are cited herein are incorporated by reference in their entirety.

What is claimed is:

1. A porous, high surface area electrode structure comprising:

a) a substrate consisting essentially of fine metallic fibers or conductive ceramic fibers having a density of less than about 50% and a specific surface area to volume ratio of greater than about 30 $cm^2/cm^3$, the individual fibers having a length to diameter aspect ratio greater than 1000:1, b) an electrocatalyst material coated on at least a portion of said substrate; and c) a current distributor electrically connected to said electrocatalyst coated substrate.

2. The porous, high surface area electrode of claim 1 wherein said substrate consists essentially of fibers of a material selected from the group consisting of the valve metals.

3. The electrode of claim 2 wherein said fibers are fabricated from a valve metal selected from the group consisting of titanium, niobium, zirconium, tantalum, aluminum, tungsten, hafnium and mixtures and alloys thereof.

4. The porous high surface area electrode of claim 1 wherein said electrocatalyst coating material is selected from the group consisting of platinum, silver, gold, and the platinum metal group oxides.

5. The electrode of claim 4 wherein the electrocatalyst material is selected from the group of platinum metal group oxides consisting of an oxide prepared from ruthenium, rhodium, palladium, iridium, osmium and mixtures and alloys thereof.

6. The electrode of claim 1 wherein said current distributor comprises a solid, perforated, or expanded metal plate attached to said substrate.

7. The electrode of claim 6 wherein said current distributor plate is fabricated from a material selected from the group consisting of an electrically conductive valve metal selected from the group comprising titanium, niobium, zirconium, tantalum, aluminum, tungsten, hafnium and mixtures and alloys thereof that is optionally coated with an electrocatalyst material selected from the group consisting of platinum, silver, gold, and the platinum group oxides.

8. The electrode of claim 1 wherein said substrate comprises a mixture of coarse and fine fibers, the coarse fiber being between about 0.01% to about 50% of the total fiber content and the ratio of the diameter of the coarse fibers to the fine fibers being in the range of from about 1.5:1 to about 10:1.

9. The electrode of claim 1 wherein said substrate comprises a mixture of coarse and fine fibers, the coarse fibers being between about 0.10% to about 40% of the total fiber content and the ratio of the diameter of the coarse fibers to the fine fibers being in the range of about 2:1 to about 8:1.

10. The electrode of claim 1 wherein the electrocatalyst material covers from about 5% to about 95% of the surface area of the substrate.

11. The electrode of claim 1 wherein the electrocatalyst forms an intermetallic or alloy with the substrate.

12. The electrode structure of claim 1 wherein the electrocatalyst coated substrate has a thickness of from about 0.01 inches to about 5 inches.

13. The electrode structure of claim 1 wherein said substrate is sintered such that the individual fibers are metallurgically bonded at fiber to fiber contact points.

14. The electrode structure of claim 1 wherein said individual fibers of said substrate are bonded together at multiple points by spot welding.

15. The electrode structure of claim 1 wherein said substrate is attached to said current distributor by mechanical means.

16. The electrode structure of claim 1 wherein said substrate is attached to said current distributor by a metallurgical bond or sintering.

17. The electrode structure of claim 1 wherein said substrate is attached to said current distributor at multiple points by spot welding.

* * * * *